US006423152B1

(12) United States Patent
Landaas

(10) Patent No.: US 6,423,152 B1
(45) Date of Patent: Jul. 23, 2002

(54) METHOD AND APPARATUS FOR TREATMENT OF INTERNAL SURFACES IN A CLOSED-LOOP FLUID SYSTEM

(75) Inventor: Torstein Landaas, Austrevigå(NO)

(73) Assignee: Intel Sampling AS, Stavanger (NO)

( * ) Notice: Subject to any disclaimer, the term of this patent is extended or adjusted under 35 U.S.C. 154(b) by 0 days.

(21) Appl. No.: 09/720,711

(22) PCT Filed: Jun. 29, 1999

(86) PCT No.: PCT/NO99/00219

§ 371 (c)(1),
(2), (4) Date: Dec. 28, 2000

(87) PCT Pub. No.: WO00/00306

PCT Pub. Date: Jan. 6, 2000

(30) Foreign Application Priority Data

Jun. 29, 1998 (NO) ..... 983021

(51) Int. Cl.[7] ..... B08B 7/04; B08B 9/00

(52) U.S. Cl. ..... 134/10; 134/11; 134/22.12; 134/22.18; 134/102.1; 134/109; 134/120.2

(58) Field of Search ..... 134/22.1, 22.12, 134/22.18, 109, 110, 102.1, 102.2, 10, 11, 8; 451/38, 39, 40, 87, 88

(56) References Cited

U.S. PATENT DOCUMENTS

| | | | | |
|---|---|---|---|---|
| 5,007,444 A | * | 4/1991 | Sundholm | 134/102.1 |
| 5,095,927 A | * | 3/1992 | Thompson et al. | 134/102.1 |
| 5,526,841 A | * | 6/1996 | Detsch et al. | 134/102.2 |
| 5,615,695 A | * | 4/1997 | Chambers | 134/102.1 |
| 5,699,817 A | * | 12/1997 | Bankers et al. | 134/102.2 |

FOREIGN PATENT DOCUMENTS

| | | |
|---|---|---|
| DE | 40 13 698 | 11/1991 |
| EP | 0 490 117 | 6/1992 |
| EP | 0 634 229 | 1/1995 |
| SU | 1 207 030 | 3/1992 |
| WO | WO 98/41337 | 9/1998 |

* cited by examiner

*Primary Examiner*—Randy Golakowski
*Assistant Examiner*—Saeed Chaudhry
(74) *Attorney, Agent, or Firm*—Young & Thompson

(57) ABSTRACT

The invention relates to a method for generating a scale-removing or coat-applying system based on a vacuum-balancing low-pressure multicomponent two-phase fluid flow. A cleaning site such as, e.g., a pipe circuit (A) or the inner cavities of a heat exchanger (B) is supplied with an already used cleaning agent in a two- or multiphase flow made up of ca. 10% liquid and ca. 90% air or gas, which after separation is used again by way of continuously monitoring the ion density of the separated liquid, using a conductivity apparatus which determines whether it shall be filtered and reused, be supplied with new liquid and/or solids, or be dumped. A liquid flow and separated air/gas flow from an air pump meet at a mixing point from where an intended two-phase flow flows to the cleaning site (A), (B), or similar, through this and then forward to return as a re-use medium. A gas-injected liquid/powder flow from a mixing unit is also used for coating, e.g., the inner surfaces of pipes and tanks, or objects placed in a suitable chamber, tunnel, or similar, where excess coating medium is returned for separation for possible re-use, re-introduction or dumping. The method operates an expansion separator (2), air pump (3), conductivity meter (5), cyclone filter (7), valve control (11), pump (12), vapor supply (13), ejector (14), mixing head (18) and sundry pressure (15), temperature (4, 6, 17, 20) and volume (16, 21) control units.

16 Claims, 2 Drawing Sheets

TURBULENCE

B

LAMINAR

A

METHOD AND APPARATUS FOR TREATMENT OF INTERNAL SURFACES IN A CLOSED-LOOP FLUID SYSTEM

This invention relates to a method for treatment in the form of scale removal from, or application of coating to, internal surfaces in a closed fluid system A,B, such as pipes and tanks, by the use of a two- or multiphased flow being brought through the fluid system. The invention also relates to an apparatus for treatment in the form of scale removal from, or application of coating to, internal surfaces in a closed fluid system A,B, such as pipes and tanks, by the use of a two- or multiphased flow being brought through the fluid system.

BACKGROUND OF THE INVENTION

Industrializing has entailed use of vast amounts of chemicals and solvents for various applications. In spite of improvements of the industrial processes and increasingly stricter standards for process cleanliness, the environment is exposed to substances that are toxic and harmful to the environment. These substanses are often very stable and only slowly decompose, if they decompose at all.

A reason for this is the use of chemicals and solvents in the industry for scale removal . In the industry there is a need for reasonable solutions entailing short shut down periods, and this often leads to use of chemical cleaning methods. The result is release of substances that are harmful to the environment.

Below various types of scale are described where chemicals and solvents frequently are utilised for scale removal:

- Algae growth and other organic deposits, e.g. in pipe networks supplying water for consumption, fire-fighting facilities and process water. Pipe networks can have major dimensions, e.g. in water mains from reservoirs to cities, and smaller dimensions such as in buildings and ships.
- Percipitation deposits of cabonates, phosphates or other chemical compounds that over time may precipitate from a fluid flow.
- Sedimentation deposits of organic compounds such as oil, kerosene, fat and vax deposits in pipelines.
- Corrotion deposits arising with oxidation over time, such as on inner surfaces in pipe systems and tanks.

Heavy-duty scale removal is to a great extent done by jet water washing and the use of a host of chemical sovents, also combined with high fluid temperatures.

Current knowledge about, and use of, chemicals and solvents is to some extent advanced high technology. The practical implementation of the methods and procedures using such agents are relatively less advanced, leading to major waste, danger of releasing these agents into the environment and of injury to personnel.

Because time reductions and cost savings are important factors for achieving the set goals, inadequate control of the properties of chemicals being present in a process activity have had to be accepted. Unstable temperatures may cause toxic-vapours and fast-corroding reactions. The concentrations of the cleaning fluid must be controlled at all times in order to achieve the intended effects and to avoid wasting chemicals. It must be possible to carry out quality checks on, e.g., work, hours and other factors of interest, both during the process and/or after completion.

Jet water washing for cleaning the inner walls of pipes calls for a high fluid velocity in the internal volume of the pipe. The same effect is achieved at lower pressure through the use of a standard two-phase flow in pipes by injecting air or another gas into the liquid flow, increasing the liquid velocity along the pipe wall.

PRIOR ART

The following is cited from patent literature: In EP 0 490 117 A1 a method is described for cleaning a pipeline with the aid of a two-phased flow based on liquid and gas, achieving an internal annular flow through the pipe, dependent on the density, surface tension, viscosity and given velocity on the fluid. The method specifies a gas/liquid mix ratio in the order of 3,000 to 7,500 $m^3$: 1 $m^3$ or in the order of 2.0 to 6.0 kg:1 kg.

The apparatus for carrying out the method comprises a source of pressurized gas adapted for blowing the gas flow through a pipeline also being connected to a source of liquid, the source of pressurized gas being dimensioned and formed for generating a two-phase flow.

SUMMARY OF THE INVENTION

There is through this invention developed a method for treatment in the form of scale removal from, or application of coating to, internal surfaces in a closed fluid system, such as pipes and tanks, by the use of a two- or multi-phase fluid flow being brought through the fluid system. The novel and inventive features are that the fluid flow is composed of liquid and gas with a substantially higher volume of gas than of liquid, being that liquid and gas in a quantity-controlled ratio and at a given pressure are supplied to a mixing head, the outlet of which is connected to an inlet to the fluid system, while an outlet from the fluid system leads to an expansion separator, that liquid and gas exit separately from the expansion separator, that the gas from the expansion separator is brought with the aid of a pump to the mixing head, that the liquid, possibly containing solid substances or particles from the expansion separator, is filtered to separate. unwanted components from the liquid, and that at least a part of the liquid is recycled to the mixing head, preferably with the aid of a pump.

For carrying out the method according to the invention, an apparatus is developed, comprising a mixing head with quantity-controlled inlets for gas and liquid, respectively, and an outlet which is adapted to be connected to an inlet to the fluid system, an expansion separator with the inlet being adapted to be connected to an outlet from the fluid system, separate outlets for gas and liquid, respectively, with possible content of solids or particles from the expansion separator, a pump for transferring the gas from the expansion separator to the gas inlet on the mixing head, a filter unit connected to the liquid outlet from the expansion separator, a valve arrangement connected to the liquid oultet from the expansion separator by means or mixing head, the filter unit, and an outlet for dumping non-reusable liquid or possibly solids or particles, and a supply line for new liquid, in that recycling of liquid to the mixing head is done preferably with the aid of a pump.

In this invention equipment can be cleaned by means of a two-phase fluid flow at relatively low pressure. Low flow pressure leads to reduction of leakages to the environment and allows for recycling of liquid and gas separately.

The invention will be described in further detail below, with reference to the attached drawings.

DESCRIPTION OF PREFERRED EMBODIMENTS

Figure 1:
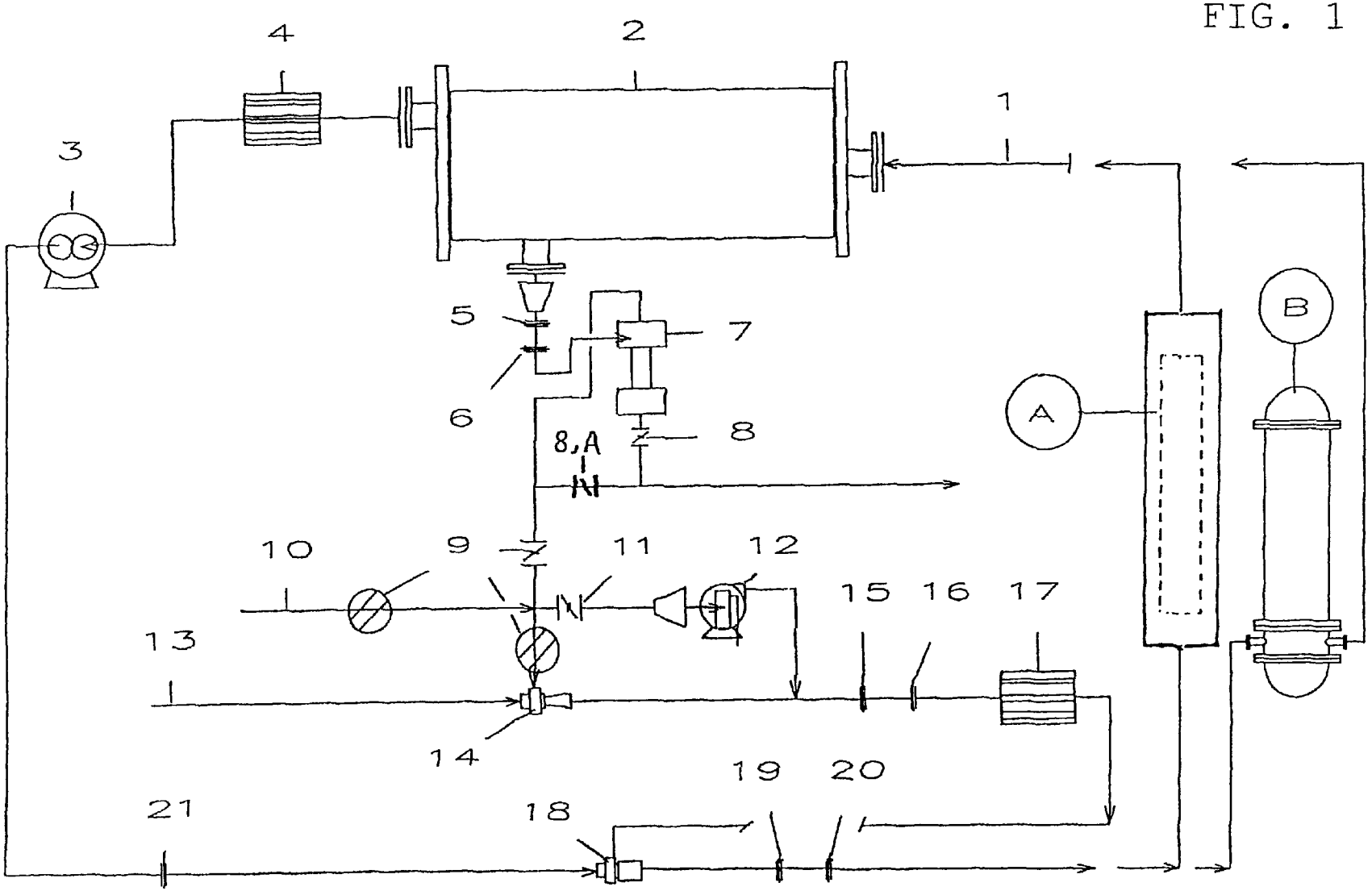
FIG. 1 shows an apparatus according to the invention for treatment in the form of scale removal from, or application of coating to, internal surfaces in a closed fluid system, such as pipes and tanks.

FIG. 1 shows an apparatus according to the invention for treatment in the form of scale removal or application of coating to internal surfaces in a closed fluid system A,B, such as pipes and tanks, by the use of a two- or multiphase fluid flow being brought through the fluid system A,B. The apparatus comprises a mixing head 18 with quantity-controlled 16,21 inlets for gas and liquid, respectively, and an outlet which is adapted to be connected to an inlet to the fluid system A,B. An expansion separator (2) has an inlet being adapted to be connected to an outlet from the fluid system. Separate outlets is arranged for gas and liquid, respectively, with possible content of solids or particles from the expansion separator 2. A pump 3 is arranged for transferring the gas from the expansion separator to the gas inlet on the mixing head 18. A filter unit 7 is connected to the liquid outlet from the expansion separator 2, a valve arrangement 9,11,8A is connected to the liquid outlet from the expansion separator 2 by means of mixing head 18, filter unit 7, and an outlet for dumping non-reusable liquid or possibly solids or particles, and a supply line 10 for new liquid, in that recycling of liquid to the mixing head 13 is done preferably with the aid of a pump 12.

Control arrangements 4,5,15,17,19,20 can be arranged for temperature and pressure at various points 4,5,15,17,19,20 in the fluid flow with the aim of monitoring and controlling the treatment.

For determining parameters regarding components in the liquid, a measuring unit 5 can be connected to the liquid outlet from the expansion separator 2, and the valve arrangement 9,11,8A can be controlled by the measuring unit 5.

By means of the apparatus according to the invention, a method for treatment in the form of scale removal from, or application of coating to, internal surfaces in a closed fluid system A,B, such as pipes and tanks, by the use of a two- or multi-phase fluid flow being brought through the fluid system can be carried out.

Two-phase fluid flow refers to a two-phase fluid flow of liquid and gas, wherein liquid and gas is denoted as phases. Fluid mechanics describes which flow regimes occurring at different velocities of liquid and gas, and the quantitative ration between liquid and gas.

The fluid flow is composed 18 of liquid and gas with a substantially higher volume of gas than of liquid, being that liquid and gas in a quantity-controlled 16,21 ratio and at a given pressure are supplied to a mixing head 18, the outlet of which is connected to an inlet to the fluid system A,B, while an outlet from the fluid system leads to an expansion separator 2. Liquid and gas exit separately from the expansion separator 2. The gas from the expansion separator 2 is brought with the aid of a pump 3 to the mixing head 18. The liquid, possibly containing solid substances or particles from the expansion separator, is filtered 7 to separate unwanted components from the liquid, and at least a part of the liquid is recycled to the mixing head 18, preferably with the aid of a pump 12.

In a preferred embodiment, the gas volume is in the order of magnitude of about 10 times that of the liquid volume, In this case, a pipe flow will be established with an annular flow, where, as seen from a cross section point of view, gas flows in the middle of the pipe and liquid along the pipe wall.

Figure 2B:
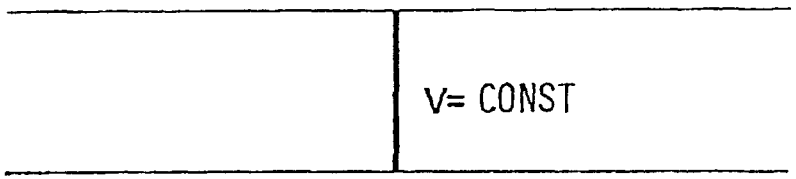
FIG. 2B is a simplified view of steady state pipe fluid flow at conditions allowing for turbulent flow.
Figure 2A:
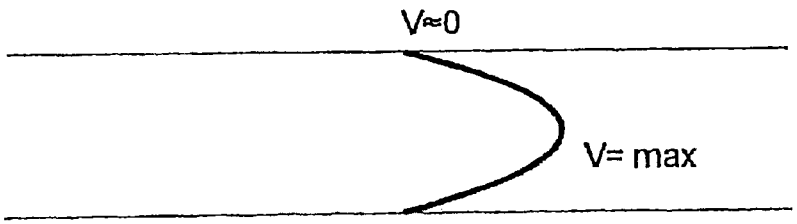
FIG. 2A is a simplified view of steady state pipe fluid flow at conditions allowing for laminar flow.

In another preferred embodiment, the liquid is brought to aerosol fog form after the mixing head 18, and the gas volume can then in the order of magnitude of about 100 times that of the liquid volume. A pipe flow will then be established where a mixture of mixture of gas and liquid in the form of aerosol fog flows through the pipe, as seen from across the whole pipe cross section. Due to the velocity of the liquid and the gas turbulent flow is achieved, being optimal for cleaning surfaces because the velocity profile for fully developed, turbulent flow is approximately uniform across the whole pipe section. Such a simplified view is illustrated in FIG. 2*b*. By laminar flow the velocity profile is approximately parabolic, the highest velocity being in the center of the pipe and low velocity being near the pipe wall. Such a simplified view can be seen in FIG. 2*a*. The liquid being in the form of aerosol fog will entail lower consumption of liquid in the cleaning process.

The liquid from the expansion separator 2 could be subject to a measurement 5 with regard to liquid components resulting from or affected by said treatment. The measurement 5 is adapted to control a valve arrangement 9,11,8A which directs the liquid for recycled supply to the mixing head 18 or to dumping of non-reusable liquid or possibly solids or particles, and which provides for the supply 10 of new liquid according to requirements. The measurement 5 can comprise electrical-conductivity measurement.

The liquid is filtered in a cyclone 7 for separation of solids. The supply of new liquid 10 may in one embodiment be accompanied by the supply of solids. In another embodiment of the invention, the supply of new liquid may in whole or in part be done in the form of vapour 13.

With the aim of monitoring and controlling the treatment, temperature and pressure are measured by means suitable means at different points 4,6,15,17,19,20 in the fluid flow.

In the case of application of coating, a coating agent can be supplied in the fluid flow before the inlet to the fluid system A,B. Excess coating agent is returned from the expansion separator 2 for recycling or dumping 8.

Advantageously, the pressure in the fluid flow (liquid and gas) can everywhere be kept lower than the ambient pressure. In this manner, leakages in the fluid flow can significantly be reduced.

What is claimed is:

1. A method of treating internal surfaces of a closed fluid system by passing a plural phase fluid flow through the fluid system to remove a scale from the system or to apply a coating to the system, comprising the steps of:

quantity-controlling the fluid flow of a liquid-gas mixture to achieve a liquid-gas volume ratio with the gas volume being a substantially higher volume than the liquid volume;

supplying the fluid flow to a mixing head having an outlet connected to an inlet of the fluid system;

having an outlet of the fluid system connected to an expansion separator;

separating and separately extracting from the expansion separator the liquid and the gas;

using a first pump to bring the gas from the expansion separator to the mixing head;

filtering the liquid leaving the expansion separator to remove particles from the liquid; and recycling at least a part of the liquid at the mixing head.

2. The treatment method of claim 1, wherein the step of recycling a part of the liquid at the mixing head is performed using a second pump.

3. The treatment method of claim 1, wherein the liquid-gas volume ratio is controlled to have the gas volume be about 10 times the liquid volume.

4. The treatment method of claim 1, wherein, after the step of supplying the fluid flow to a mixing head, the liquid is brought to an aerosol fog form; and the liquid-gas volume ratio is controlled to have the gas volume be about 100 times the liquid volume.

5. The treatment method of claim 1, wherein, the liquid extracted from the expansion separator is measured for liquid component changes; and the step of recycling at least a part of the liquid at the mixing head is controlled by a valve arrangement using the measured liquid component change to direct the liquid for recycling at the mixing head if the measured liquid component changes are satisfactory and to dumping the liquid if the measured liquid component changes are unsatisfactory; and the valve arrangement is operated to supply new liquid to the mixing head according to a new liquid requirement.

6. The treatment method of claim 5, wherein the measurement of the liquid component changes comprises an electrical-conductivity measurement.

7. The treatment method of claim 5, wherein the step of valve arrangement being operated to supply new liquid to the mixing head further provides a supply of solids.

8. The method of claim 1, wherein the step of filtering the liquid leaving the expansion separator is performed by a cyclone.

9. The treatment method of claim 1, wherein the step of supplying the fluid flow provides the fluid at least in part as a vapor.

10. The treatment method of claim 1, comprising the further step of monitoring temperature and pressure at different points and using the monitored temperature values and pressure values as treatment control values.

11. The treatment method of claim 1, comprising the further steps of:

supplying a coating agent to the fluid flow at a point prior to the inlet of the fluid system; and extracting the coating agent from the expansion separator for recycling or dumping.

12. The treatment method of claim 1, comprising the further step of maintaining a pressure of the fluid flow always lower than an ambient pressure.

13. An apparatus for removing scale from internal surfaces of a closed system or for applying a coating to the internal surfaces of the fluid system by passing a plural phase fluid flow through the fluid system, comprising:

a mixing head having an outlet connectable to an inlet of the fluid system, the mixing head having a quantity-controlled gas inlet for a gas and a quantity-controlled liquid inlet for a liquid;

an expansion separator having an inlet connectable to an outlet from the fluid system, the expansion separator having a gas outlet for the gas and a separate liquid outlet for the liquid, the liquid outlet passing particles contained within the liquid, the gas outlet being connected via a first pump to the gas inlet of the mixing head;

a filter unit connected to the liquid outlet;

a valve arrangement connecting the liquid outlet to the liquid inlet of the mixing head, the filter unit, and an outlet for dumping non-reusable liquid; and a new liquid supply line connected to the mixing head for supplying new liquid.

14. The apparatus of claim 13, further comprising a second pump connected to the new liquid supply line.

15. The apparatus of claim 13, further comprising devices for monitoring temperature and pressure of the fluid flow; and control devices driven by the monitored temperatures and pressures.

16. The apparatus of claim 13, further comprising a measuring unit connected to the liquid outlet of the expansion separator for determining properties of the liquid at the liquid outlet, wherein the valve arrangement is controlled by the measuring unit.

* * * * *